US008328322B2

(12) United States Patent
Ueda

(10) Patent No.: US 8,328,322 B2
(45) Date of Patent: Dec. 11, 2012

(54) INKJET PRINTER

(75) Inventor: Masashi Ueda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 467 days.

(21) Appl. No.: 12/342,057

(22) Filed: Dec. 22, 2008

(65) Prior Publication Data

US 2009/0167796 A1 Jul. 2, 2009

(30) Foreign Application Priority Data

Dec. 28, 2007 (JP) ..... 2007-340693

(51) Int. Cl.
*B41J 29/393* (2006.01)
*B41J 2/165* (2006.01)

(52) U.S. Cl. ..... 347/19; 347/5; 347/6; 347/20; 347/22; 347/23; 347/29; 347/30; 347/31; 347/36

(58) Field of Classification Search ..... 347/19, 347/23, 31, 86
See application file for complete search history.

(56) References Cited

U.S. PATENT DOCUMENTS

| | | | | |
|---|---|---|---|---|
| 5,606,353 | A * | 2/1997 | Mochizuki et al. | 347/23 |
| 6,102,517 | A | 8/2000 | Kobayashi et al. | |
| 6,142,600 | A * | 11/2000 | Takahashi et al. | 347/23 |
| 6,174,042 | B1 * | 1/2001 | Kobayashi et al. | 347/23 |
| 6,361,138 | B1 * | 3/2002 | Seino et al. | 347/19 |
| 6,502,916 | B1 * | 1/2003 | Naka | 347/14 |
| 6,565,184 | B1 | 5/2003 | Numata et al. | |
| 2002/0167555 | A1 | 11/2002 | Miura et al. | |
| 2005/0219336 | A1 * | 10/2005 | Hayasaki et al. | 347/86 |
| 2008/0204496 | A1 | 8/2008 | Yoshida | |

FOREIGN PATENT DOCUMENTS

| | | | |
|---|---|---|---|
| EP | 0999063 | A2 | 5/2000 |
| JP | H06-340092 | A | 12/1994 |
| JP | H10-181046 | A | 7/1998 |
| JP | 2004-074590 | A | 3/2004 |
| JP | 2005-288845 | A | 10/2005 |
| JP | 2006-192732 | A | 7/2006 |
| JP | 2007-118339 | A | 5/2007 |
| JP | 2007-223266 | A | 9/2007 |
| WO | WO97/23352 | A1 | 7/1997 |

OTHER PUBLICATIONS

Japan Patent Office; Notice of Reasons for Rejection in Japanese Patent Application 2007-340693 mailed Dec. 4, 2009.
European Patent Office, European Search Report for European Patent Application No. 08254112.9, dated Nov. 26, 2009.
The State Intellectual Property Office of the People's Republic of China, Notification of the Third Office Action for Chinese Patent Application No. 200810149960.9, issued May 24, 2011.

* cited by examiner

*Primary Examiner* — Ryan Lepisto
(74) *Attorney, Agent, or Firm* — Baker Botts L.L.P.

(57) ABSTRACT

An inkjet recording device includes an ink cartridge receiving unit configured to receive an ink cartridge, an inkjet head configured to eject ink, an ink passage configured to transport the ink from the ink cartridge to the inkjet head, a detecting unit configured to detect a type of ink cartridge received in the ink cartridge receiving unit, a waste ink collection unit including an absorber configured to absorb the ink, a discharging unit configured to discharge the ink remaining in the ink passage at one of a first discharging rate and a second discharging rate, and a controller configured to control the discharging unit to discharge an amount of ink. The controller is configured to control the discharging unit to discharge ink at one of the first discharging rate and the second discharging rate corresponding to the type of the ink cartridge detected by the detecting unit.

19 Claims, 6 Drawing Sheets

Fig. 6

Cartridge Replacement

An unknown cartridge has been set. To protect the ink head, the ink in the tube will also be replaced. (To prevent ink leakage due to the replacement of the ink in the tube, a step of drying ink to be discarded will be executed (a long standby time will occur).)

OK

INKJET PRINTER

CROSS REFERENCE TO RELATED APPLICATION

This application claims priority to and the benefit of Japanese Patent Application No. 2007-340693, filed Dec. 28, 2007, the entire subject matter and disclosure of which is incorporated herein by reference.

BACKGROUND OF THE INVENTION

1. Field of the Invention

The present invention relates to an inkjet printer.

2. Description of the Related Art

A conventional inkjet printer is supplied ink by mounting an ink cartridge in an ink cartridge receiving unit. The inkjet printing apparatus is designed to perform printing by using a predetermined suitable type of ink, e.g., a pigment ink, a dye ink, or the like, contained in the ink cartridge. If an ink cartridge containing an unsuitable ink is mounted, a risk of clogging may increase. Therefore, it is preferable to use the ink cartridge containing the predetermined type of ink.

In a known inkjet printer, when an unexpected ink cartridge is mounted, the known inkjet printer discharges a large amount of ink in a maintenance operation, and this accelerates the ink discharge to a high speed.

In a known inkjet printer, ink that is discharged by a maintenance operation is collected by a collection unit, e.g., a waste ink tank. A porous member, e.g., a sponge, is provided inside such a tank, and waste ink is absorbed by the sponge. In this case, if the type of the waste ink is known, a total amount of waste ink is determined according to the type of the waste ink, on the basis of a discharge amount of waste ink per unit time, and a time for which waste ink should be discharged. Ink absorption ability, e.g., ink absorption rate, of the sponge is determined on the basis of these parameters. If no consideration is given to the ink absorption ability of the sponge and an amount of waste ink beyond the ink absorption ability is discharged, the waste ink may not be absorbed by the sponge and may overflow the waste ink tank into the printer, which may damage a circuit board or other portion of the printer.

If the above parameters are known, the discharge amount of waste ink per unit time can be increased to a value that is almost equal to the waste ink absorption rate of the sponge. Therefore, the discharge amount of waste ink per unit time can be set so that the time taken until completion of discharge of waste ink is made shortest, e.g., the discharge amount of waste ink per unit time is maximized, according to the waste ink absorption rate. Nevertheless, if a large amount of ink of an unsuitable ink cartridge, e.g., ink whose material properties are unsuitable is discharged, the discharge amount per unit time may exceed the maximum waste ink absorption rate, because a rate at which the ink having unsuitable material properties is absorbed by the sponge may not be assumed. The waste ink may overflow the waste ink tank into the printer and damage a circuit board or other portion of the printer.

SUMMARY OF THE INVENTION

A need has arisen to provide an inkjet recording device which may discharge a larger amount of ink to prevent or reduce ink coagulation due to mixing of different types of inks and may prevent or reduce the overflow of the waste ink tank. To attain the above need, the invention provides an inkjet recording device comprising an ink cartridge receiving unit configured to receive an ink cartridge and an inkjet head configured to eject an ink. The inkjet recording device further comprising an ink passage configured to transport the ink from the ink cartridge to the inkjet head and comprising a detecting unit configured to detect a type of the ink cartridge received in the ink cartridge receiving unit. The inkjet recording device still further comprising a waste ink collection unit comprising an absorber configured to absorb the ink, and comprising a discharging unit configured to discharge ink remaining in the ink passage at one of a first discharging rate and a second discharging rate. Moreover, the inkjet recording device comprising a controller configured to control the discharging unit to discharge an amount of the ink. The controller is configured to control the discharging unit to discharge ink at one of the first discharging rate and the second discharging rate corresponding to the type of the ink cartridge detected by the detecting unit.

BRIEF DESCRIPTION OF THE DRAWINGS

FIG. 6 shows an example alarm message according to an embodiment of the invention.

DETAILED DESCRIPTION OF THE INVENTION

Figure 1:
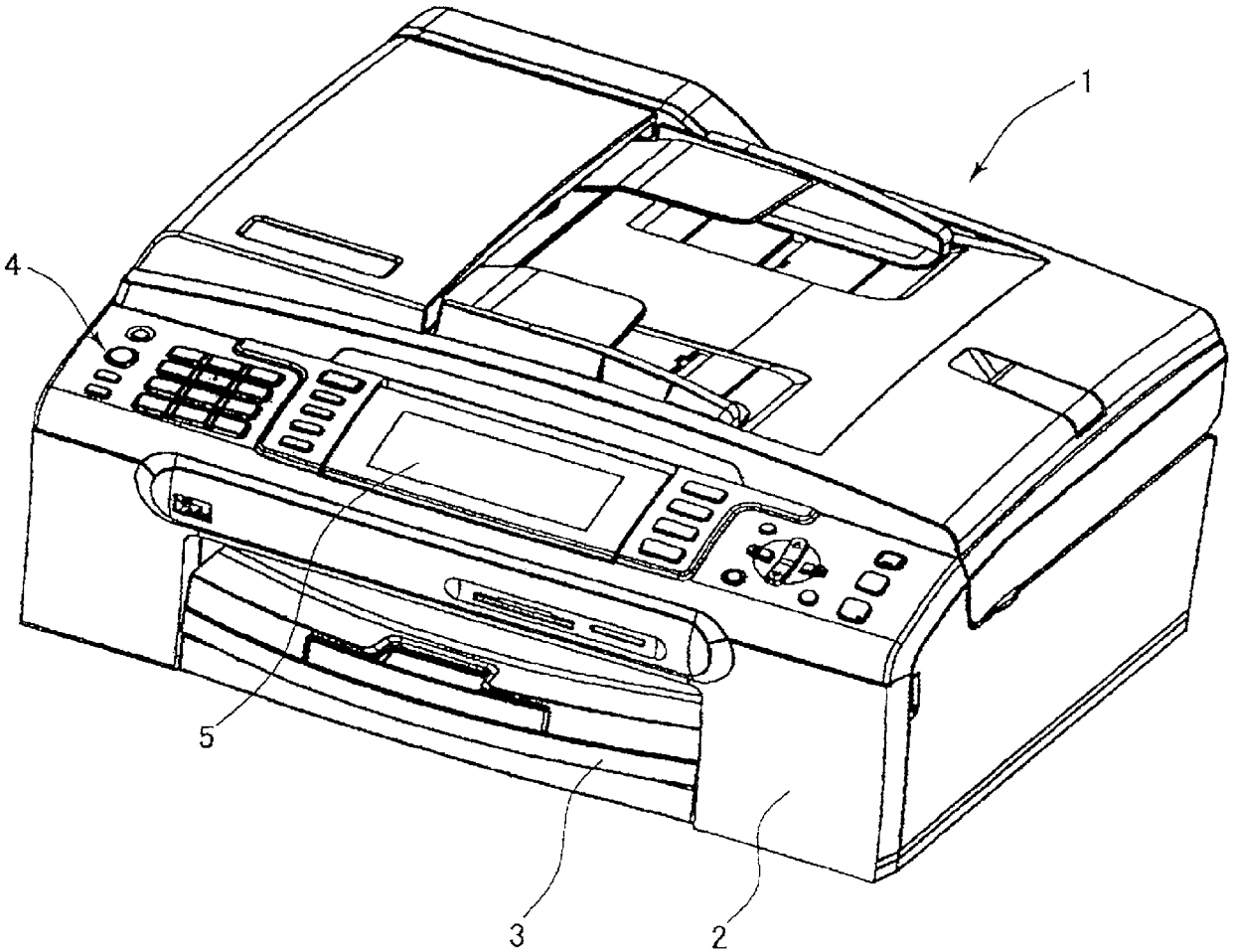
FIG. 1 is a perspective view showing an appearance of an inkjet printer according to an embodiment of the invention.

FIG. 1 is a perspective view showing an inkjet printer 1 according to an embodiment of the invention.

In the inkjet printer 1, ink cartridges 70 may contain respective inks, and may be mounted in an ink supply unit 2. As shown in FIG. 1, the ink supply unit 2 comprises a lid, and the ink cartridges 70 may be mounted into the ink supply unit 2 by opening the lid. Various manipulations for cartridge replacement, etc., may be performed using an operating panel 4, and various messages relating to a printing operation may be displayed on a display unit 5. Printing sheets may be supplied to a sheet tray 3.

Figure 2:
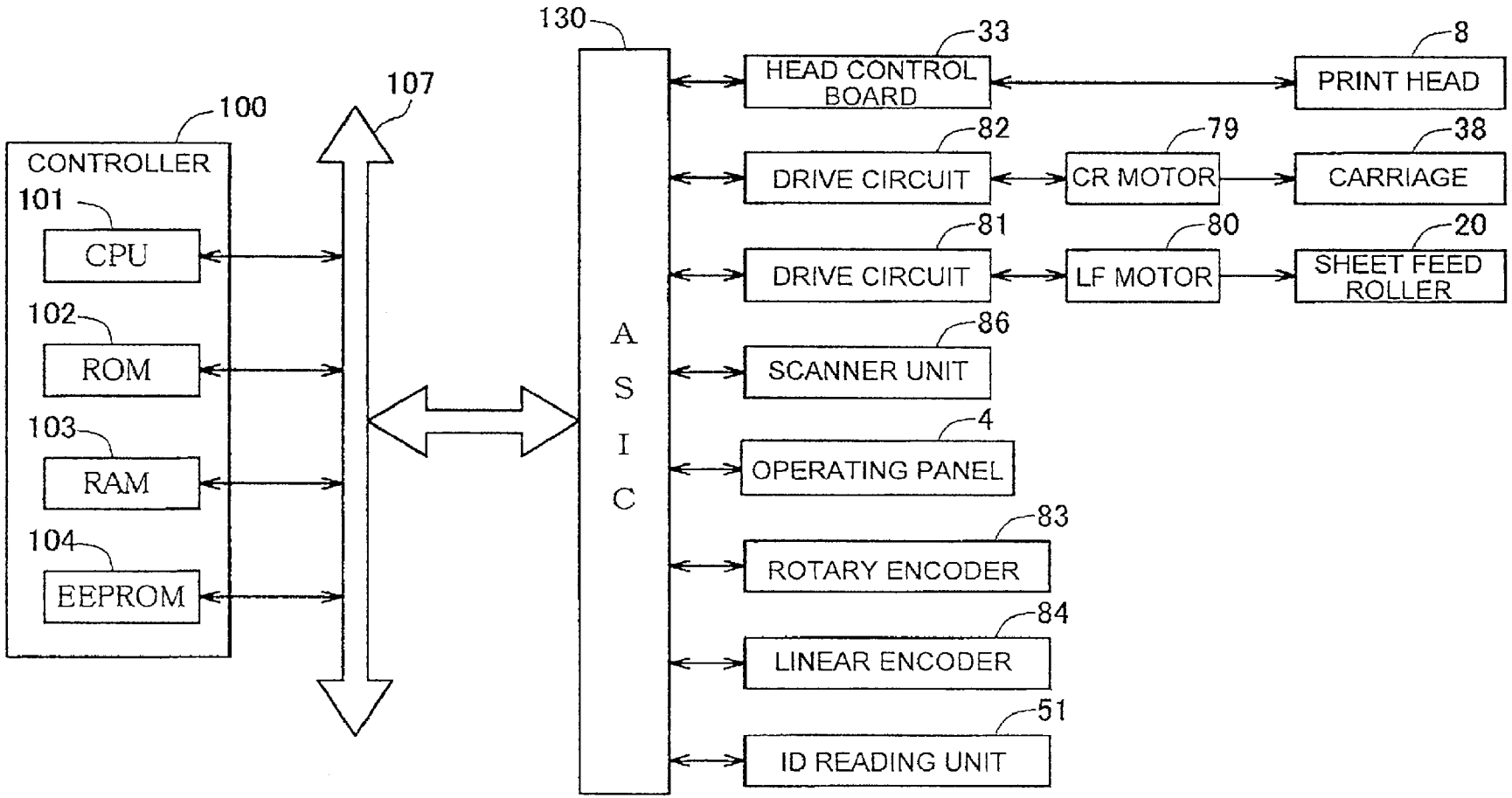
FIG. 2 is a block diagram relating to information processing of the inkjet printer according to an embodiment of the invention.

FIG. 2 is a block diagram relating to information processing of the inkjet printer 1. A control unit 100 may comprise a CPU 101 which controls processing, a ROM 102 in which control programs may be stored, a RAM 103 where a program and data may be developed, and an Electrically Erasable Programmable Read-Only Memory("EEPROM") 104 which may be a nonvolatile memory. The control unit 100 thus may control the entire printer 1.

Commands that may be sent from the control unit 100 may be transmitted, via a bus 107, after being converted with an ASIC 130 into forms suitable for them, to circuits and boards, e.g., a head control board 33 for controlling an inkjet head 8, drive circuits 81 and 82 for driving motors, a scanner unit 86, the operating panel 4 for manipulating the inkjet printer 1, a rotary encoder 83 for measuring a rotation speed of rollers, a linear encoder 84 to be used for moving a carriage 38 correctly, and ID reading units 51, e.g., an ink cartridge type detecting unit, e.g., a detecting unit, for reading identifications, e.g., IDs of IC chips, e.g., identification portions, such as memory chips, that may be mounted on the ink cartridges, respectively.

The CR motor 79 and the LF motor 80 may drive the carriage 38 and sheet feed rollers 20, on the basis of signals that are output from the drive circuits 81 and 82, respectively. Signals that may be output from the circuits and boards, such as the head control board 33, the drive circuits 81 and 82, the scanner unit 86, the operating panel 4, the rotary encoder 83, the linear encoder 84, and the ID reading unit 51, may be transmitted to the control unit 100 after being converted with the ASIC 130 into signals having timing that may be suitable for the bus 107.

Figure 4:
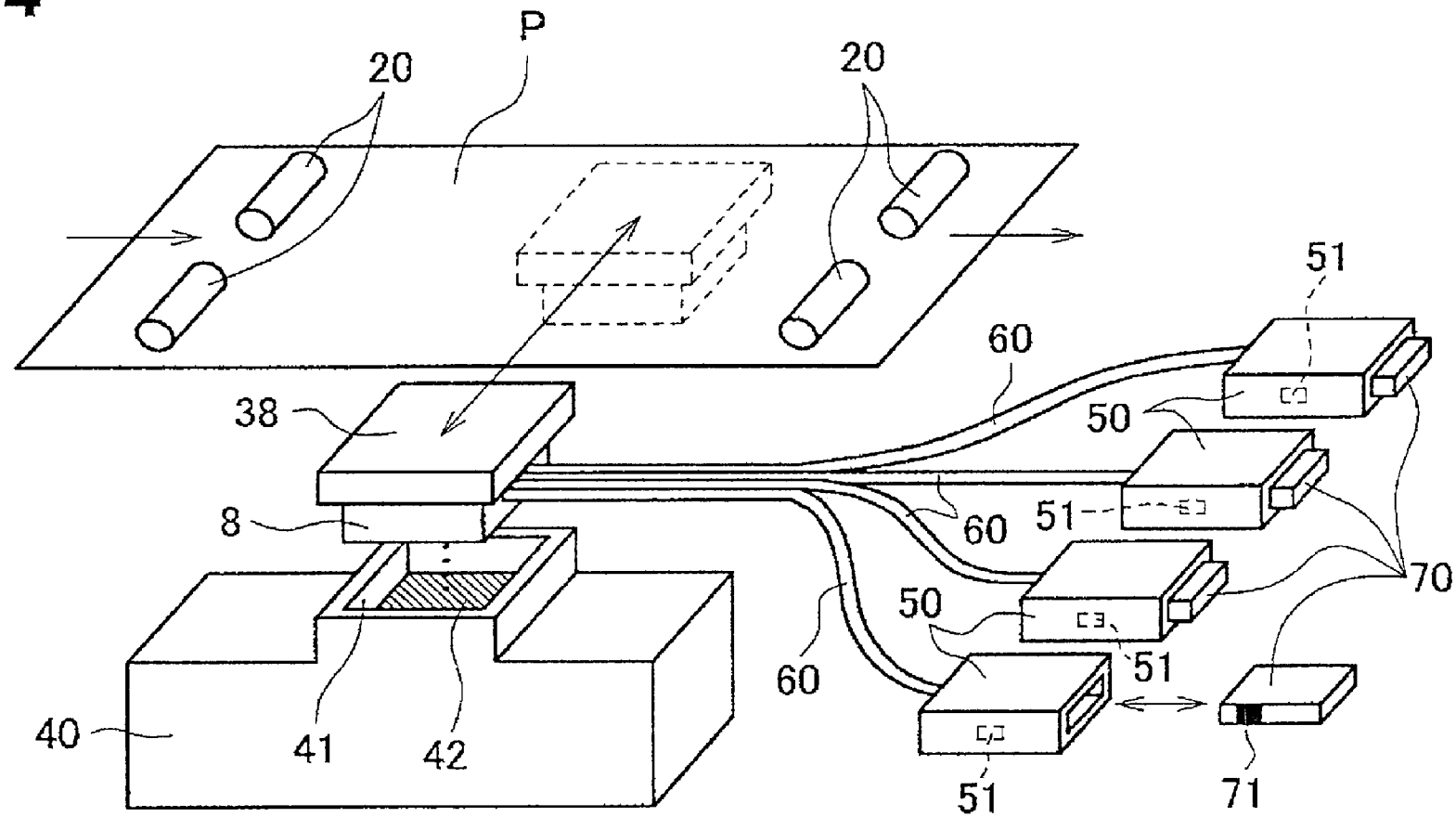
FIG. 4 shows the configuration of a portion of the inkjet printer, relating to a flushing operation according to an embodiment of the invention.

FIG. 4 outlines a configuration, relating to a printing operation using the inkjet head 8, and a maintenance operation of the inkjet printer 1 according to an embodiment. As shown in FIG. 4, a printing sheet P. e.g., a printing medium, may be transported in a horizontal direction as the sheet feed rollers 20 rotate. In a state that the printing sheet P is located under the inkjet head 8, ink droplets may be ejected from the nozzles of the inkjet head 8, in a printing operation. In FIG. 4, the printing sheet P is oriented horizontally.

Ink tubes 60, e.g., ink passages, may extend from the inkjet head 8 to respective ink cartridge receiving units 50. Ink cartridges 70 may be mounted in the respective ink cartridge receiving units 50 in a replaceable manner, and inks may be supplied from the ink cartridges 70 to the inkjet head 8 via the ink tubes 60. The ink cartridge receiving units 50 may be disposed inside the lid of the above-mentioned ink supply unit 2. As shown in FIG. 4, the ink cartridges 70, the ink cartridge receiving units 50, and the ink tubes 60 may be provided in one or more of, e.g., four, systems, which may correspond to one or more of, e.g., four, respective colors, e.g., black, yellow, cyan, and magenta.

As shown in FIG. 4, the inkjet head 8 may transfer together with the carriage 38 in the horizontal direction, that is, perpendicularly to the transport direction of the sheet P. The movement direction of the carriage 38 may be restricted by a guide rail (not shown). This movement of the inkjet head 8 may enable printing on the entire surface of the sheet P. The movement of the inkjet head 8 and the ejecting of inks from the inkjet head 8 may be controlled by commands that are output from the control unit 100.

Furthermore, the inkjet head 8 and the carriage 38 may be moved in the same manner, to outside the range of the sheet P, such that inkjet head 8 and carriage 38 may be located over a waste ink tank 40, e.g., an ink collection unit. As described herein, when the inkjet head 8 and carriage 38 are in this position, an ink discharge may be performed by a flushing operation at the time of ink cartridge replacement. In this state, ink may be ejected toward the inside of the waste ink tank 40 from the inkjet head 8, which may be moved to over a discharge mouth 41 located at the top of the waste ink tank 40. A porous member 42, e.g., an absorber, made of sponge, felt, cellulose, or the like, may be disposed inside the waste ink tank 40. Since the porous member 42 may be disposed inside the waste ink tank 40, discharged ink may be absorbed by the porous member 42 and may be held stably.

With the above apparatus configuration, in an embodiment, maintenance with ink discharge may be performed by a flushing operation when an ink cartridge 70 is replaced. In the inkjet printer 1, since ink in the vicinity of the aperture of each nozzle of the inkjet head 8 may be in direct contact with the air, ink solvent may volatilize, and dye or pigment may be deposited on the aperture surface, which may increases the ink viscosity. The flushing operation may be an operation of ejecting out ink of increased viscosity from the nozzles.

For example, the flushing operation may be performed regularly during printing operations, or when a lack of dots occurs during printing. With the configuration of FIG. 4, as described above, an ordinary flushing operation may be performed in a state in which the inkjet head 8 has been moved to over the discharge mouth 41 of the waste ink tank 40. In an embodiment, an ink discharge also may be performed by a flushing operation when an ink cartridge 70 is replaced, to avoid a mixing of different types of inks.

Figure 3:
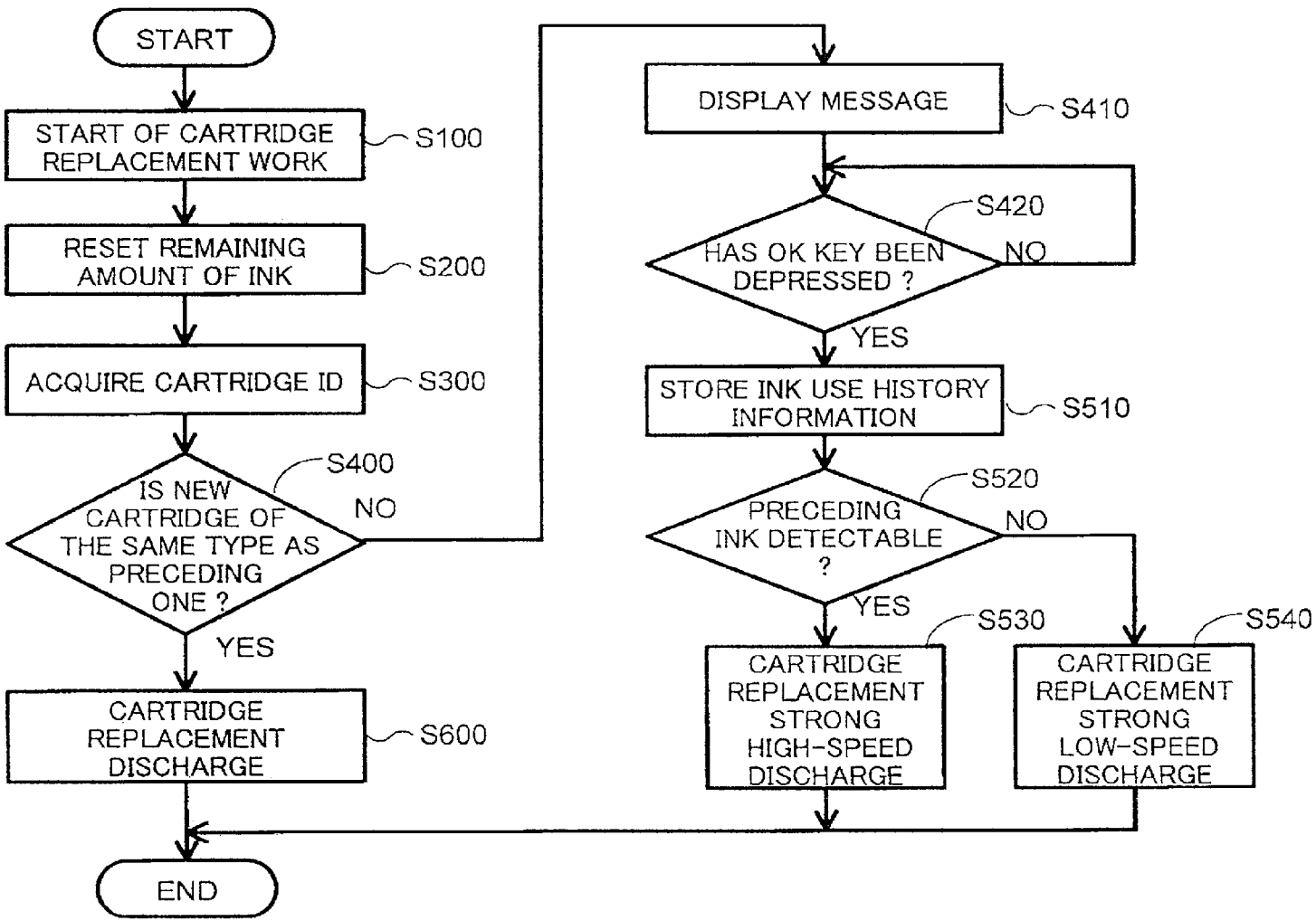
FIG. 3 is a flowchart of a process which is executed after replacement of an ink cartridge according to an embodiment of the invention.

FIG. 3 is a flowchart of a process which may be executed after replacement of an ink cartridge 70 according to an embodiment of the invention. The steps of the process may be executed in response to commands sent from the control unit 100.

At step S100, the inkjet printer 1 may recognize a start of cartridge replacement work, e.g., detects opening of the lid of the ink supply unit 2 or recognizes removal of an ink cartridge 70. At step S200, the inkjet printer 1 may reset the remaining amount of ink.

At step S300, the control unit 100 may instruct the ID reading unit 51 to read an ID of a latest ink cartridge 70, e.g., to detect the type of the ink cartridge received by the ink cartridge receiving unit 50. In response, the ID reading unit 51 reads electronic information, e.g., identifying information, such as an ID, that may be stored in an electronic information storing chip 71, e.g., a memory chip, of the ink cartridge 70. As shown in FIG. 4, ID reading units 51 may be provided in respective ink cartridge receiving units 50.

The reading of electronic information which may be performed at step S300, may be a process of obtaining binary information, which may indicate a type of the ink cartridge 70 mounted in the corresponding ink cartridge receiving unit 50. The binary information may indicate not only the type of the ink cartridge 70 but also "verifiable" or "unverifiable." "Verifiable" may mean that electronic information may be read from the electronic information storing chip 71, and that read-out information may correspond to predetermined electronic information that may be specific to the printer type that was registered by the manufacturer. On the other hand, "unverifiable" may mean that electronic information may not be read from the electronic information storing chip 71, or that electronic information may be read out, but the read out electronic information may not correspond to the predetermined electronic information that may be specific to the printer type that was registered by the manufacturer. The predetermined electronic information that is specific to the printer type may be registered such that that the read-out information may not correspond to the predetermined electronic information when the electronic information may not be read from the electronic information storing chip 71. Another reason the cartridge may be "unverifiable," e.g., that electronic information may not be read from the electronic information storing chip 71, may be the case that no electronic information storing chip 71 is mounted on the ink cartridge 70.

At step S400, the control unit 100 may determine whether the ink cartridge 70 that has been mounted this time, e.g., the ink cartridge received by the ink cartridge receiving unit 50, or the ink cartridge detected by the detecting unit, is of the same type as the preceding ink cartridge 70. "Of the same type" may mean that both of the latest ink cartridge 70 and the preceding ink cartridge 70 have read out information that corresponds to the predetermined electronic information. On the other hand, "not of the same type" may mean that the read out information of at least one of the latest ink cartridge 70 and the preceding ink cartridge 70 may not correspond to the predetermined electronic information. If both the latest ink cartridge 70 and the preceding ink cartridge 70 are "unverifiable," then control unit 100 may determine that the cartridges are "not of the same type," even if the latest ink cartridge 70 and preceding ink cartridge 70 are the same type of "unverifiable" ink cartridge.

Control unit 100 may store information of whether the read-out information of preceding ink cartridge 70 is "verifiable" or "unverifiable" because of a prior execution of step S510, which will be described herein. If the latest ink cartridge 70 is of the same type as the preceding one, e.g., "YES" at Step S400, the process may move to step S600. If the latest ink cartridge 70 is not of the same type as the preceding one, e.g., "NO" at Step S400, the process may move to step S410. At Step S600, a cartridge replacement discharge, which will be described in more detail herein, may be performed. Then, the execution of the process may be completed. A cartridge replacement strong discharge may be performed at step S410 and the following steps, which will be described in more detail herein.

The cartridge replacement discharge and the cartridge replacement strong discharge will be described herein. The cartridge replacement discharge may be processing for, for example, discharging ink into, and ejecting air bubbles from, the ink tube 60 and the nozzles of the inkjet head 8, by performing a flushing operation as described above when a cartridge 70 is replaced.

As described above, if both of the preceding ink cartridge 70 and the latest ink cartridge 70 correspond to the predetermined electronic information, e.g., that it may be confirmed that the preceding ink and the latest ink may be the same ink, then the process may be at Step S600. Therefore, a mixing of different types of inks may not occur in the ink tube 60. Therefore, in the cartridge replacement discharge which may be performed at step S600, a smaller amount of ink may be discharged than in the cartridge replacement strong discharge, which will be described in more detail herein.

Next, the cartridge replacement strong discharge will be described. As described above, if one or both of the preceding ink cartridge 70 and the latest ink cartridge 70 may not correspond to the predetermined electronic information, e.g., the ink in the ink tube 60 may be of a different type than the ink in the latest ink cartridge 70, e.g., a state of mixing of different types of inks. Specifically, since the type of the "unverifiable ink" may be unknown, the two inks likely may be of different types. The ink that remained in the ink tube 60 when a cartridge 70 was replaced may come into contact with the ink in a latest ink cartridge 70. If the inks are brought into contact with each other, the inks may begin to diffuse into each other. As a result, if the two inks have different ink properties, the inks may coagulate inside the ink tube 60, which may disrupt a later printing operation. To avoid or reduce this phenomenon, it may be preferable to discharge the ink in the ink tube 60.

Therefore, if it is determined that the latest ink cartridge 70 is of a different type than the preceding ink cartridge 70, a cartridge replacement strong discharge is performed. The cartridge replacement strong discharge may be an operation that may completely replace at least the ink remaining in the ink tube 60 with the latest ink, to prevent or reduce ink coagulation due to mixing of different types of inks.

Therefore, in the cartridge replacement strong discharge, more ink is discharged than in the cartridge replacement discharge described previously. A mixture of different types of inks may also occur outside the ink tube 60, e.g., in the latest ink cartridge 70. Therefore, the total amount of discharged ink may be set, for example, as 1 to 1.5 times larger than the capacity of the ink tube 60.

At step S410, an alarm message, e.g., to the effect that a large amount of ink may be consumed, relating to the cartridge replacement strong discharge may be displayed. After recognizing the alarm message, if the user agrees to perform a cartridge replacement strong discharge, at Step S420 the user may indicate his or her intention of agreement, e.g., by depressing an OK button, or by depressing a button corresponding to an OK button on the operating panel 4, or by clicking on an OK button, or a button corresponding to the OK button that may be included in the alarm message displayed on a terminal that may be connected to the inkjet printer 1.

The display of the alarm message may allow the user to know that a cartridge replacement strong discharge is to be performed after the replacement with the latest ink cartridge 70. FIG. 6 shows an example alarm message. If the user's intention of agreement has been confirmed by, for example, depression of the OK button, at Step S510, information indicating whether the latest ink cartridge 70 corresponds to the predetermined electronic information or not, e.g., a type of latest ink cartridge 70, may be stored in the EEPROM 104. As described above, the information indicating whether the latest ink cartridge 70 corresponds to the predetermined electronic information may be used at the determining steps S400 and S520, e.g., as a type of previous ink cartridge 70, at the time of the next ink cartridge replacement.

At Step S520, it is determined whether the preceding ink previously corresponded to the predetermined electronic information If the preceding ink corresponded to the predetermined electronic information, e.g., "YES" at Step S520, the process may move to Step S530, e.g., a step of cartridge replacement strong high-speed discharge. If the preceding ink did not correspond to the predetermined electronic information, e.g., "NO" at Step S520, the process may move to Step S540, e.g., a step of cartridge replacement strong low-speed discharge. In this manner, the cartridge replacement strong discharge may be classified into two types, e.g., the cartridge replacement strong high-speed discharge, and the cartridge replacement strong low-speed discharge. These two types of cartridge replacement strong discharge will be described in more detail herein.

The process may reach step S530, e.g., the step of cartridge replacement strong high-speed discharge, if the preceding ink cartridge 70 corresponded to the predetermined electronic information, and the latest ink cartridge 70 does not correspond to the predetermined electronic information, as seen from the determining results of steps S400 and S520. Therefore, the ink in the ink tube 60, which may be the ink of the preceding ink cartridge 70, may be predetermined ink. On the other hand, the process may reach Step S540, e.g., cartridge replacement strong low-speed discharge if the preceding ink cartridge 70 may not correspond to the predetermined electronic information, as seen from the judgment results of steps S400 and S520. Therefore, the ink in the ink tube 60 may not be the predetermined ink.

When ink is discharged by the cartridge replacement strong discharge, there may occur an event that ink may not immediately be absorbed by the porous member 42 disposed in the waste ink tank 40, and ink may overflow the waste ink tank 40. Since the absorption rate may be determined by the combination of the material of the porous member 42 and the ink composition, if the ink type is known, the absorption rate may be set to such a value that may not cause an ink overflow from the waste ink tank 40. Nevertheless, if the preceding ink is unknown, then the absorption rate may not be able to be set. Furthermore, in the cartridge replacement strong discharge, the discharge amount may be larger than in an ordinary flushing operation, which may increase the importance of reducing the risk of ink overflow.

In view of the above, at Step S530, e.g., cartridge replacement strong high-speed discharge, since the composition of the ink in the ink tube 60 may be known, flushing may be performed at a high speed. For example, the term "high speed" may mean a highest speed in a range that may allow ink to be absorbed by the porous member 42. Fastest discharge rates in such a range that ink can be absorbed by the porous member 42, which may be employed at Step S530, may be determined in advance for respective known inks. As mentioned above, the porous member 42 may be made of a material selected from a variety of materials, e.g., sponge, felt, cellulose, and the like. Therefore, fastest discharge rates, in such a range that ink that may be discharged at Step S530 may not overflow the waste ink tank 40, may be determined in advance, with respect to the types of materials which may be used as the porous member 42. As a further alternative, fastest discharge rates may be determined in advance for combinations of known inks and types of materials of the porous member 42, in such a range that ink can be absorbed by the porous member 42. In an embodiment of the invention, such fastest discharge rates may be stored in a memory, e.g., the ROM 102, and the like, and may employ, at Step S530, a discharge rate that may be equal to or lower than an applicable fastest discharge rate.

At Step S540, e.g., the cartridge replacement strong low-speed discharge, since the composition of the ink in the ink tube 60 may be unknown, flushing may be performed at a lower speed, such that ink may not overflow the waste ink tank 40. As is understood from the above description, in the cartridge replacement strong high-speed discharge, high-speed flushing may allow a maintenance operation to be performed without forcing the user to wait for a long time. Nevertheless, in the cartridge replacement strong low-speed discharge, low-speed flushing may allow a use of an apparatus in which it is important to avoid overflow of an unknown ink.

The level of "low speed" of the cartridge replacement strong low-speed discharge may be varied according to different embodiments of the invention. In an embodiment of the invention, the total flushing time may be set in advance, e.g., to 10 or 15 minutes, or the like. In another embodiment of the invention, two low-speed levels may be set in advance, and the lower low-speed level may be employed before a command for the next print job may be received, and the higher low-speed level may be employed after a command for the next print job may be received. In this embodiment, it may be possible to flexibly accommodate the presence or absence of a print job.

The high speed and the low speed of the cartridge replacement strong discharge may be realized by changing the ejecting interval of the flushing operation. Specifically, for example, the flushing operation may be such that a prescribed number of ink droplets are ejected emptily each time. In this example, the time interval between ejecting operations of a prescribed number of ink droplets may be set to be shorter in the case of the cartridge replacement strong high speed discharge, and may be set to be longer in the case of the cartridge replacement strong low-speed discharge. In this case, it may be preferable to use, as a process for ejecting a prescribed number of ink droplets each time, a corresponding process of an ordinary flushing operation, e.g., a flushing operation not related to cartridge replacement, which may allow the system to be made simpler.

Figure 5:
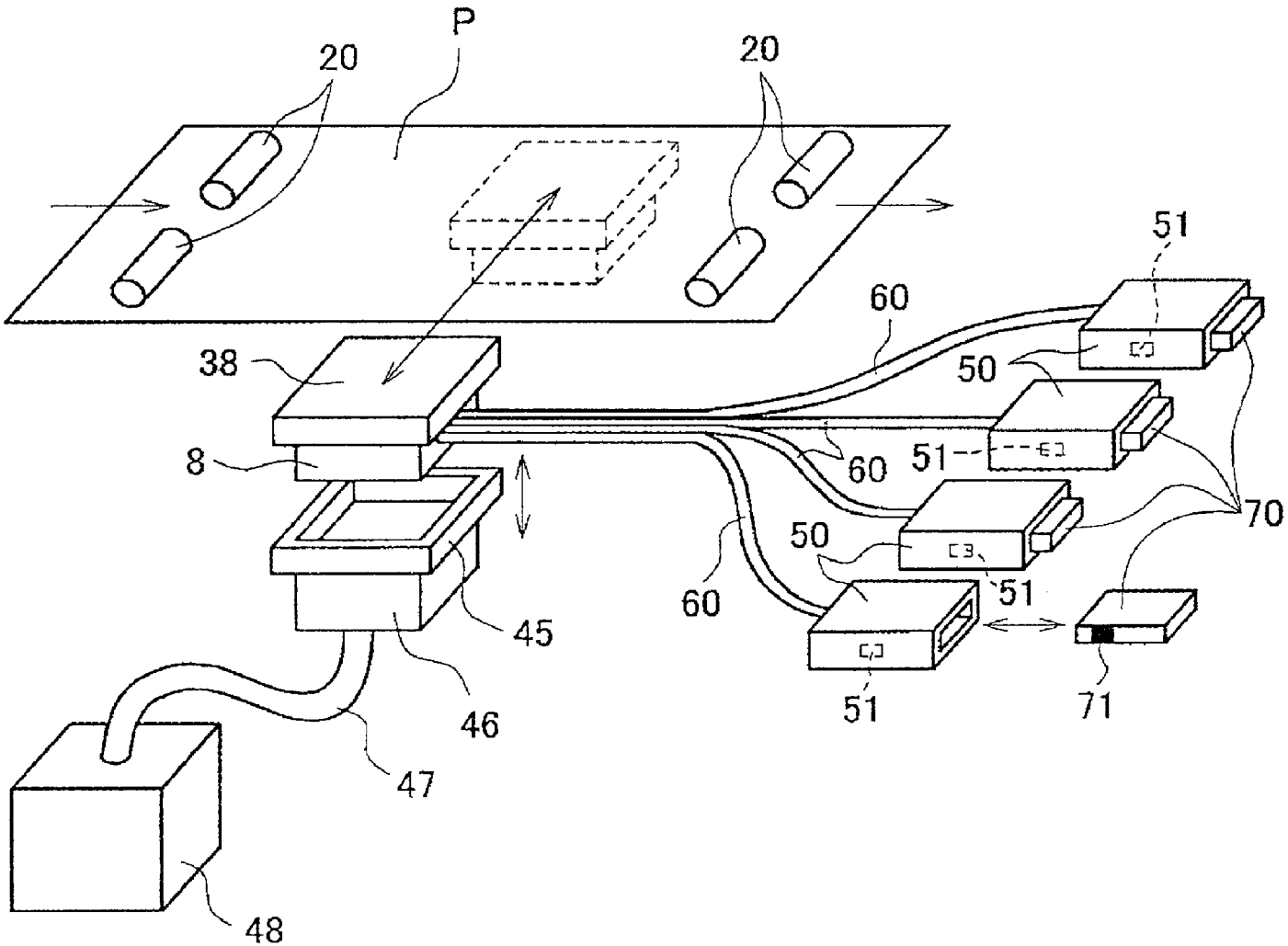
FIG. 5 shows the configuration of a portion of the inkjet printer, relating to a purge operation according to another embodiment of the invention.

FIG. 5 shows another embodiment of the invention. Only features which may differ from the previously described embodiment will be described herein.

In the embodiment shown in FIG. 5, instead of the configuration of FIG. 4, a purge operation is performed instead of the flushing operation of the previously described embodiment. In the following embodiment, the purge operation may be a suction purge operation. The suction purge operation may be a maintenance operation in which ink is drawn out of the nozzles of the inkjet head 8, to remove air bubbles and foreign substances from the nozzles, or to discharge ink into the nozzles. The structure for the suction purge of this embodiment may be replaced by another structure, e.g., the structure for a known pressure purge.

In the configuration of FIG. 5, a purge mechanism may comprise a cap 45, a pump 46, a tube 47, and a waste ink tank 48, e.g., another example of an ink collection unit. The cap 45 may be brought into close contact with the inkjet head 8, and may draw ink using suction force generated by the pump 46. Drawn-out ink may be collected by the waste ink tank 48 through the tube 47. The cap 45 may be brought into close contact with the inkjet head 8 by an upward movement from a moving mechanism (not shown). Similarly to the embodiment shown in FIG. 4, a porous member made of sponge, felt, cellulose, or the like, may be disposed in the waste ink tank 48.

The process described in FIG. 3 also may be employed in the current embodiment. With the configuration of FIG. 5, if a large amount of ink is discharged at high speed when an ink cartridge 70 is replaced, the ink may not be fully collected by the waste ink tank 48 and, for example, may overflow through the cap 45. Therefore, similarly to the previously described embodiment, the cartridge replacement strong low-speed discharge, e.g., Step S540 may be effective to prevent ink overflow in waste ink tank 48.

What is claimed is:

1. An inkjet printer comprising:

an ink cartridge receiving unit configured to receive an ink cartridge;

an inkjet head configured to eject an ink;

an ink passage configured to transport the ink from the ink cartridge to the inkjet head;

a detecting unit configured to detect a type of the ink cartridge received in the ink cartridge receiving unit;

a waste ink collection unit comprising an absorber configured to absorb the ink;

a discharging unit configured to discharge ink remaining in the ink passage to the waste ink collection unit at one of a first ink amount per unit time and a second ink amount per unit time; and a controller configured to control the discharging unit to, during a recovery operation which is caused by an exchange of the ink cartridge, discharge a first discharging amount of the ink at the first ink amount per unit time if the ink cartridge detected by the detective unit satisfies a first condition and discharge a second discharging amount of ink including all the ink remaining in the ink passage at the second ink amount per unit time, which is less than the first ink amount per unit time, if the ink cartridge detected by the detecting unit satisfies a second condition, to the waste ink collection unit.

2. The inkjet printer according to claim 1, wherein the inkjet head is configured to eject ink toward one of a recording medium and the waste ink collection unit.

3. The inkjet printer according to claim 1, further comprising a memory configured to store the type of ink cartridge detected by the detecting unit, and to store at least one previous type of ink cartridge previously detected by the detecting unit, wherein the controller is configured to compare the type of the ink cartridge stored in the memory, to the at least one previous type of ink cartridge, wherein the at least one previous type of ink cartridge corresponds to a type of an ink cartridge most recently mounted on the ink cartridge receiving unit.

4. The inkjet printer according to claim 3, wherein the type of ink cartridge detected by the detecting unit is one of a first predetermined type and a second predetermined type.

5. The inkjet printer according to claim 4, wherein the second predetermined type corresponds to an unverifiable type of ink cartridge.

6. The inkjet printer according to claim 5, wherein when one of the type of ink cartridge detected by the detecting unit is the second predetermined type, and the at least one previous type of ink cartridge is the second predetermined type, the controller is configured to control the discharging unit to discharge the second discharging amount of ink.

7. The inkjet printer according to claim 3, wherein the memory comprises a first memory portion and a second memory portion, and the type of ink cartridge detected by the detecting unit is stored in the first memory portion, and the at least one previous type of ink cartridge is stored in the second memory portion.

8. The inkjet printer according to claim 3, wherein the controller controls the discharging unit to discharge the second discharging amount of ink when a result of the comparison between the type of the ink cartridge and the at least one previous type of ink cartridge indicates that the type of the ink cartridge and the at least one previous type of ink cartridge are different.

9. The inkjet printer according to claim 3, wherein the controller is configured to control the discharging unit to discharge the ink in the ink passage at the second ink amount per unit time when the at least one previous type of the ink cartridge stored in the memory is not a predetermined type.

10. The inkjet printer according to claim 3, wherein:

the controller is configured to determine a type of the ink corresponding to the type of the ink cartridge detected by the detecting unit, and the controller is configured to determine that the type of ink corresponding to the type of the ink cartridge mixes with a different type of ink corresponding to the at least one previous ink cartridge, when a result of the comparison between the type of the ink cartridge and the at least one previous type of ink cartridge indicates that the type of the ink cartridge and the at least one previous type of ink cartridge are different.

11. The inkjet printer according to claim 1, wherein the discharging unit is configured to discharge the ink by executing a flushing operation of ejecting the amount of the ink from the inkjet head to the waste ink collection unit.

12. The inkjet printer according to claim 1, wherein the discharging unit is configured to discharge the ink by executing a purging operation of drawing the amount of ink from the inkjet head to the waste ink collection unit.

13. The inkjet printer according to claim 1, wherein the detecting unit is configured to read data stored in a memory chip received when the ink cartridge receiving unit receives the ink cartridge.

14. The inkjet printer according to claim 1, wherein the controller is configured to determine a type of the ink corresponding to the type of the ink cartridge detected by the detecting unit.

15. An inkjet printing system comprising:

an ink cartridge configured to store an ink and comprising an identification portion; and an inkjet printer comprising:

an ink cartridge receiving unit configured to receive the ink cartridge;

an inkjet head configured to eject the ink;

an ink passage configured to transport the ink from the ink cartridge to the inkjet head;

a detecting unit configured to detect a type of the ink cartridge received in the ink cartridge receiving unit using the identification portion of the ink cartridge;

a waste ink collection unit comprising an absorber configured to absorb the ink;

a discharging unit configured to discharge ink remaining in the ink passage to the waste ink collection unit at one of a first ink amount per unit time and a second ink amount per unit time; and a controller configured to control the discharging unit to, during a recovery operation which is caused by an exchange of the ink cartridge, discharge a first discharging amount of the ink at the first ink amount per unit time if the ink cartridge detected by the detective unit satisfies a first condition and discharge a second discharging amount of ink including all the ink remaining in the ink passage at the second ink amount per unit time, which is less than the first ink amount per unit time, if the ink cartridge detected by the detecting unit satisfies a second condition, to the waste ink collection unit.

16. The inkjet printer according to claim 15, wherein the identification unit comprises a memory chip, and the detecting unit is configured to detect the type of the ink cartridge by reading a data stored in the memory chip.

17. The inkjet printer according to claim 15, wherein the ink cartridge is configured to store a particular type of ink, and the controller is configured to determine the particular type of ink by determining the type of the ink cartridge detected by the detecting unit.

18. The inkjet printer according to claim 15, wherein the inkjet printer further comprises a memory configured to store at least one previous type of ink cartridge, and the controller is configured to compare the type of the ink cartridge detected by the detecting unit to the at least one previous type of ink cartridge, wherein the at least one previous type of ink cartridge corresponds to a type of an ink cartridge most recently mounted on the ink cartridge receiving unit.

19. The inkjet printer according to claim 18, wherein the ink cartridge is configured to store a particular type of ink, and the controller is configured to determine the particular type of ink by determining the type of the ink cartridge detected by the detecting unit, and the controller is configured to determine that the particular type of ink mixes with a further type of ink corresponding to the at least one previous ink cartridge, when a result of the comparison between the type of the ink cartridge detected by the detecting unit and the at least one previous type of ink cartridge indicates that the type of the ink cartridge detected by the detecting unit and the at least one previous type of ink cartridge are different.

* * * * *